United States Patent [19]

Pickles

[11] 4,157,001

[45] Jun. 5, 1979

[54] FURNACE LININGS

[75] Inventor: Allan E. Pickles, Merseyside, England

[73] Assignee: The Carborundum Company, Niagara Falls, N.Y.

[21] Appl. No.: 869,187

[22] Filed: Jan. 13, 1978

[30] Foreign Application Priority Data

Jan. 15, 1977 [GB] United Kingdom ..... 1642/77

[51] Int. Cl.[2] ..... F23M 5/00; E04B 1/62

[52] U.S. Cl. ..... 52/506; 52/410; 110/336

[58] Field of Search ..... 52/506, 511, 410; 29/455, 453, 526; 220/445; 228/134, 136, 139; 110/1 A

[56] References Cited

U.S. PATENT DOCUMENTS

| | | | |
|---|---|---|---|
| 3,670,917 | 6/1972 | Nishimaki et al. | 220/445 |
| 3,702,024 | 11/1972 | Baker | 29/455 |
| 3,742,670 | 7/1973 | Byrd | 110/1 A |
| 3,771,467 | 11/1973 | Sweet | 52/506 |
| 3,881,288 | 5/1975 | Fay | 29/526 |
| 3,909,907 | 10/1975 | Davis | 52/249 |
| 4,030,261 | 6/1977 | Coleman | 52/506 |

*Primary Examiner*—James L. Ridgill, Jr.
*Attorney, Agent, or Firm*—David E. Dougherty; Raymond W. Green

[57] ABSTRACT

There is disclosed a device for securing refractory and/or insulating material against a furnace wall. The device comprises a metal pin or stud which is attached to the wall at one end and is provided with a plurality of notched portions adjacent the other end. The stud cooperates with a hollow, preferably ceramic anchor, which is provided with a rectangular slot that fits over the notched portion of the stud and may be secured thereon by rotating an anchor through 90 degrees to effect a locking arrangement. The anchors may be interfitted in order to provide a support for electrical heating elements. The significant feature is that the size of the anchor is such as to allow another anchor to interlock and make a collar which can support electrical heating elements. As the anchor is preferably a ceramic support it is electrically insulating, and prevents the electrical heating elements from contacting the studs.

11 Claims, 5 Drawing Figures

FURNACE LININGS

BACKGROUND OF THE INVENTION

This invention relates to the construction, especially the lining, of furnace walls and is particularly concerned with installations utilizing blankets, bats, or blocks of relatively lightweight refractory or heat insulating materials usable at relatively high temperatures.

Many methods and devices have been previously suggested for securing refractory and/or insulating materials as linings to the interior walls of a furnace. In many of such methods or devices the lining is required to have a specific shape, or elaborate hardware on the furnace walls is required. In many instances an exorbitant amount of labor is required. Consequently, there has been a demand for a construction which permits the convenient attachment of refractory and/or insulating material in the form of blankets, sheets, bats, or blocks to furnace walls with a minimum of hardware and accessories and without exposing mounting hardware to furnace atmosphere and temperature.

It has been previously proposed to provide simple and convenient means for lining the walls by securing blankets, sheets, blocks, or bats of ceramic refractory and/or heat-insulating material on furnace walls either in a single layer or in a plurality of layers. In constructing or installing the lining the securing or mounting means may be easily applied wherever necessary or desired, thus giving a flexibility to furnace wall construction which is absent in many prior systems.

Essentially the mounting or securing devices utilized in said previous proposal consist of cup-like or truncated conical ceramic retaining members or anchors, and elongated metal studs by which the anchors are located. Each metal stud is adapted to be secured to a metal wall surface and to so engage an associated ceramic retainer as to hold it in position. More specifically, the metal studs are attached, such as by welding, to the surface of a wall to be insulated, extending essentially perpendicularly from said wall, and having such external configuration as to engage the body of refractory and/or insulating material. The truncated conical ceramic retaining members (hereinafter for convenience referred to as "anchors") may be installed with the desired spacing between them by locating the associated metal stud, forming a hole in the refractory or insulating material around the stud, inserting the anchor therein so as to engage the stud, and locking the anchor to the stud by rotating 90 degrees. The interior portion of the anchor may then be filled with a suitable refractory material so as to protect that portion of the stud projecting therein.

It is often necessary to support electrical heating elements in a furnace lined in the aforesaid manner and this has hitherto been achieved by mounting ceramic bobbins on separate, elongated metal studs secured to a metal wall surface of the furnace. This has the disadvantage that a number of extra components need to be held in stock.

It is an object of the present invention to obviate this disadvantage.

SUMMARY OF THE INVENTION

According to different aspects of the present invention there are provided:

1. A high temperature insulation construction comprising (1) a structural supporting member, (2) a body of insulating material superimposed over the structural supporting member, (3) a metallic stud bearing a plurality of pairs of anchor-engaging notches, the stud being attached at one end of the stud to the structural supporting member and disposed essentially perpendicular to the structural supporting member; and (4) an anchor positioned over the stud and engaging a first pair of notches in the metallic stud, to hold the body of insulating material between the anchor and the structural supporting member, the anchor having a cavity and being so shaped and dimensioned as to permit an identical anchor to be partially inserted within the cavity in the first anchor and engage a second pair of notches in the metallic stud, the second pair of notches being more distant from the structural supporting member than the first.

2. Such a construction, comprising in addition a removable second anchor fitted within the cavity of the first anchor, engaging the second pair of notches in the metallic stud, so as to permit supporting electrical heating elements.

3. An anchor for use in such a construction, having a tapering shank open at one end at which a radial flange provides a shoulder for trapping a body of insulating material, the other end being closed by a wall having an aperture therein for the passage of a stud, the anchor having a cavity and being so shaped and dimensioned as to permit an identical anchor to be partially inserted therein.

DETAILED DESCRIPTION

The invention will now be described in detail, by way of example only, with reference to the drawings.

Figure 1:
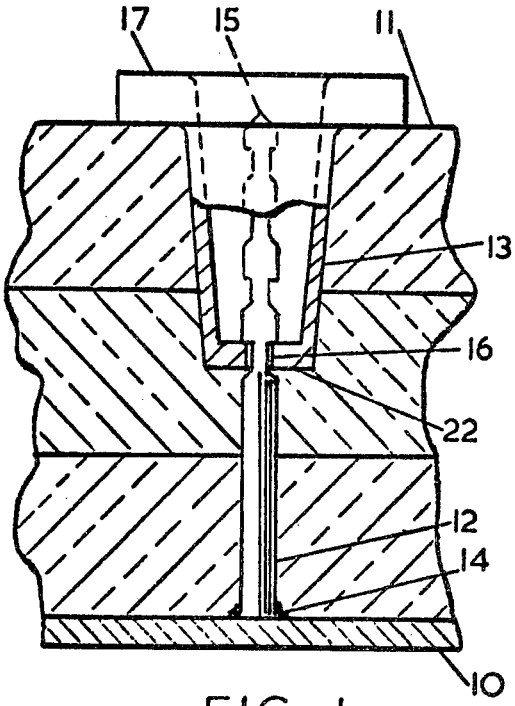
FIG. 1 is a side elevation view, partly in section, of an insulation construction according to the invention.

In FIG. 1 there is depicted in section a portion of a furnace wall, designated 10, having a body of refractory and/or insulating material 11 superimposed thereon, each of said components being effectively united and secured together by means of studs 12 and ceramic locking anchors 13. The metal stud 12, may be secured to the structure 10 by any appropriate means, such as by welds, 14, and is adjacent to the exterior or cool face of the structure, and the ceramic anchor 13 extends through and beyond the insulation surface in the direction of the interior or hot face. To facilitate the mounting and positioning of the insulating body by means of impalement upon the stud 12, the terminal end of the stud is preferably formed in a point, 15. The ceramic anchor 13, is provided with a rectangular slot 16 in the base thereof, positioned and sized to cooperate and engage with the stud 12, whereby the anchor may be slipped over the end of the stud, past the notched sections 19 thereof (see FIG. 3), and then turned through 90 degrees to form a locking engagement.

Figure 2:
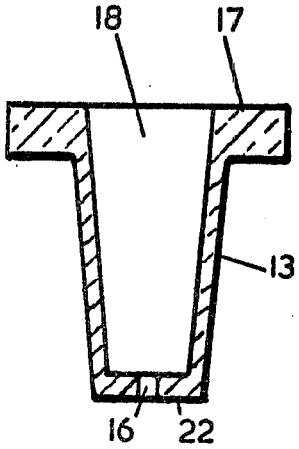
FIG. 2 is a sectional view of a ceramic anchor forming part of the construction shown in FIG. 1.

FIG. 2 illustrates the ceramic anchor 13, which is in the form of a truncated cone. The anchor comprises a high temperature resistant body having shoulders 17, which function to hold insulating material 11 in position. The ceramic anchor 13 engages the metal stud 12, by means of a rectangular slot 16, located in anchor base 22. The end of the stud then extends into the cavity, or bowl of the cup, 18.

Figure 3:
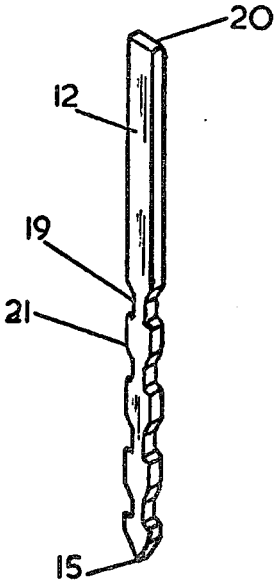
FIG. 3 is a perspective view of a metal stud forming part of the construction shown in FIG. 1.

As illustrated in FIG. 3, the metal stud 12, is substantially rectangular in cross section and has one pair of opposed sides narrower than the other pair. A plurality of pairs of discrete opposed notches 19 are disposed along the end of stud 12 opposite the welding or attachment end 20. The notches 19 are cut into the narrower sides of stud 12. The aperture 16 in the ceramic anchor 13 is of a configuration complementary with but slightly larger than the unnotched portions 21 of the rectangular stud.

Figure 4:
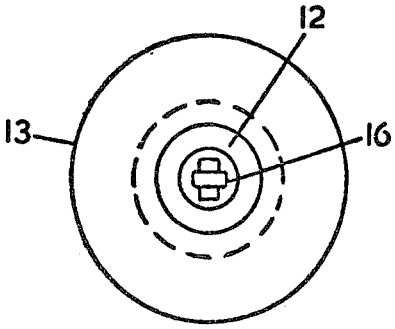
FIG. 4 is an end view of the anchor and stud assembly in locked position.

During assembly, anchor 13 will be pushed downwardly over the stud 12 until the proper compression has been applied to the lining 11, as shown in FIG. 1. When this point has been reached, the anchor is then rotated through 90 degrees in the particular pair of discrete opposed notches 19 that are available at the point that aperture 16 engages the stud, as illustrated in FIG. 4. The minimum distance between the opposed walls of notches 19 is less than the minor dimension of the aperture 16 in anchor 13, and consequently less than the minor dimension of the rectangular stud 12. Additionally, the length of notches 19 is substantially greater than the thickness of anchor base 22. By this arrangement, the anchor 13 may be moved along the stud 12 to the desired notch and freely rotated to the locking position. Once the anchor has been rotated into locking position, it is then released, and the resilient force of the lining 11 will push anchor 13 against the shoulders of the opposed notch. In this manner, anchor 13 is secured against unintentional rotation. If desired, the notches may be so designed as to taper outwardly from the longitudinal axis of the stud toward the pointed end 15. In this case, the resiliency of the lining will bring the tapered walls of the notch into contact with the sides of the aperture, affording greater freedom from possible rotation.

After engagement and locking of the stud and anchor assembly the end of the stud protrudes into cavity 18 of the anchor. Since metal is subject to oxidation and deterioration at elevated temperatures, it is desirable to insulate this portion of the stud. This may be accomplished simply, by packing the cavity with a suitable refractory material. For example, bulk fiber or blanket trim may be pressed into the cavity. Alternatively, a refractory cement may be placed in the cavity, which will harden upon heating. In the preferred embodiment, the stud is proportioned so that the pointed end 15 does not extend beyond the shoulder 17 of the ceramic anchor. If the stud extends beyond the shoulders it may be cut off, by snippers for example, to ensure insulating of all metallic components of the assembly.

Various high temperature resistant materials are suitable for the practice of this invention. For example, the metal stud 13 may be prepared from such metals as stainless steels 301 and 304, or Inconel TM 601, a high solids-solution alloy commercially available from The International Nickel Company. The ceramic anchor 13 is suitably made from refractory materials such as mullite, alumino-silicate refractories, Alfrax® fused alumina refractory, or Mullfrax®, a furnace mullite refractory available from The Carborundum Company of Niagara Falls, New York. The refractory lining materials 11 may suitably be any high temperature refractory fiber blanket or felt, such as alumino-silicate fibers. A particularly suitable material is Fiberfrax® refractory fiber insulation available from The Carborundum Company of Niagara Falls, New York.

Figure 5:
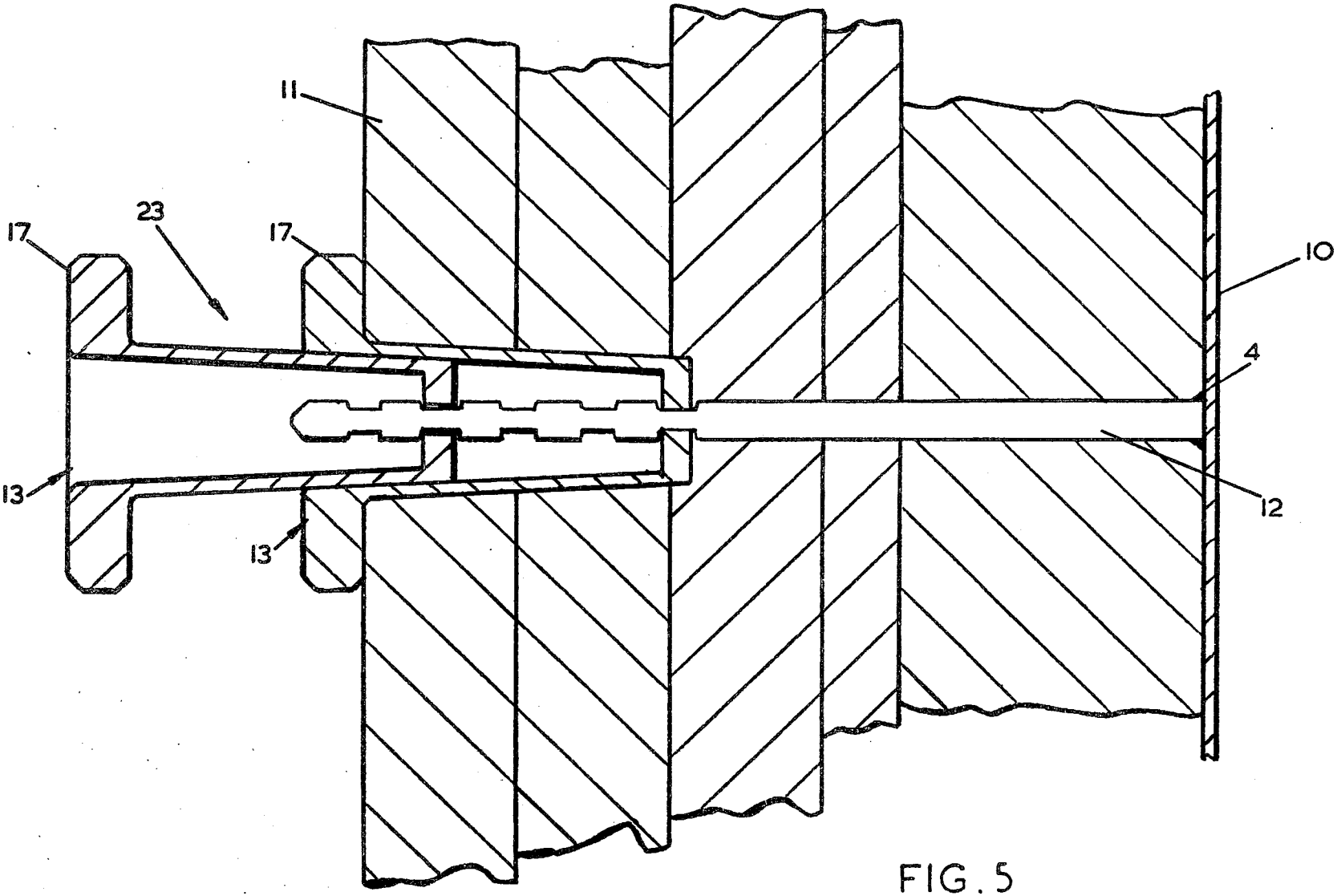
FIG. 5 is a sectional view of an insulation construction according to the invention when adapted to support electrical elements.

The ceramic anchors 13 are all of the same size and shape and are designated to fit one within the other in the manner shown in FIG. 5, to provide a support, generally indicated at 23, for electrical heating elements (not shown). The support 23 has the general appearance of a bobbin of which the checks or flanges are defined by the shoulders 17 of the interfitting anchors 13 and the core or reel portion is defined by a section of the tapering body portion of the inner anchor 13. The electrical heating elements are trained over the cores of the supports 23 and are retained by the check or shoulder 17 of the inner anchor 13. "Inner" and "outer" anchors 13 are designated such according to their relationship to each other. Thus the outer anchor 13 is installed first, and is closer to the furnace wall 10.

It will be appreciated that when the inner anchor 13 is removed the construction shown in FIG. 5 is substantially the same as that shown in FIG. 1, and like parts have in fact been designated by the same reference numerals and are not further described. The mounting and positioning of the insulating body proceeds as described above with reference to FIG. 1. However, when packing the cavity of any anchor 13 with a suitable refractory material as described, account must be taken of whether that particular anchor is intended to locate an inner anchor 13 so as to provide an electrical heating element support 23. If it is so intended, then the cavity of the outer anchor 13 is either left unpacked or is only packed to a limited extent compatible with location of the inner anchor 13 therein.

At those locations where a support 23 is to be provided, the tapering body portion of an inner anchor 13 is inserted into the cavity of the outer anchor 13 forming part of the attachment means for the insulating body. The extent of such insertion is obviously limited by the design and when the inner anchor 13 has been inserted to the fullest extent possible it is twisted to lock it in position on stud 12. The cavity of the inner anchor 13 may now be packed with a suitable refractory material.

As has already been indicated the support 23 is provided by two identical components, namely the inner and outer anchors 13, fitting one within the other. It will be appreciated that the inner anchor 13 could be replaced by a different component having a suitable spigot formation adapted to be received in the socket formation provided by the cavity of the outer anchor 13. While such a modification would obviously vitiate some of the advantages of the preferred embodiment described with reference to the drawings, it would nevertheless afford an improvement over the previous proposal in utilizing a pre-existing attachment site of the insulating body for the additional purpose of supporting electrical heating elements. This modification would also afford the possibility of making the core portion of the bobbin-like support 23 cylindrical rather than tapering in shape, which may prove to be an advantage. The same end may be achieved by redesigning the external shape of the anchors 13 shown in the drawings although it is preferred that the outer anchor 13 have a tapering configuration over its full length for ease of penetration into the insulating body 11.

In a further modification the notched, rectangular section studs 12 having pairs of discrete opposed notches 19 are replaced by circular section studs in which the notches are connected to form a threaded stud and the anchors are held in position by nuts.

As previously pointed out, the construction of the present invention is adapted for use in lining a furnace wall with a ceramic insulating and/or refractory body comprising one or more layers. It will be understood that in many instances there is little difference chemically between the ceramic materials used in refractory compositions and heat-insulating compositions. For example, a dense, bonded alumina body has a fairly good heat conductivity while a bonded body in which the alumina is in the form of hollow bubbles will be a good heat insulator. Accordingly, the distinction between an insulating material or composition and a refractory material or composition as used herein may reside only in the density or form of the material. In general, when a plurality of layers is used, the outer layer is primarily chosen for refractory properties, while a ceramic material having a lower heat-conductivity is employed for the inner layer. However, in some cases only a single layer of adequately insulating refractory may be used. In other cases, three or more layers of varying properties may be used if desired. The layers of insulating and/or refractory materials may be provided in a choice of forms such as bats, blankets, sheets, blocks and the like. For primarily insulating purposes blankets, bats or sheets of mineral wool or other ceramic fiber and sheets or blocks of ceramic-bonded, hollow ceramic bubbles are among the useful materials. Where a higher refractoriness is wanted denser bodies or layers are used, for example blocks of sheets of bonded alumina-silica ceramic fiber are very satisfactory. If desired, for example to make installation more convenient, a plurality of the layers of insulating and/or refractory material may be secured together by suitable means, such as a silicate cement, or even glue, but this is not essential.

The assembly of the present invention has been described in respect to its use for securing refractory linings to the walls of furnaces and the like. However, it is anticipated that the assembly may have many other uses in environments other than refractory furnaces.

What is claimed is:

1. A high temperature insulation construction comprising (1) a structural supporting member, (2) a body of insulating material superimposed over the structural supporting member, (3) a metallic stud bearing a plurality of pairs of anchor-engaging notches, the stud being attached at one end of the stud to the structural supporting member and disposed essentially perpendicular to the structural supporting member;

(4) a first anchor positioned over the stud and engaging a first pair of notches in the metallic stud, to hold the body of insulating material between the anchor and the structural supporting member, the first anchor having a tapered cavity which is shaped and dimensioned as to permit an identical anchor to be partially inserted within the cavity in the first anchor and engage a second pair of notches in the metallic stud, the second pair of notches being more distant from the structural supporting member than the first; and (5) a removable second anchor, essentially identical to the first anchor, fitted within the cavity of the first anchor, engaging the second pair of notches in the metallic stud.

2. A construction as claimed in claim 1, wherein the anchors are made of ceramic material.

3. A construction as claimed in claim 1, wherein the stud is attached to the support member by welding.

4. A construction as claimed in claim 1, wherein the anchors have shoulder means for retaining the insulating material.

5. A construction as claimed in claim 1, wherein said second anchor is cylindrical in configuration.

6. A construction as claimed in claim 1, wherein the shape of said anchor is a truncated cone.

7. A construction as claimed in claim 1, wherein the metallic stud is of rectangular cross section and the notches are discrete.

8. A construction as claimed in claim 1, wherein the metallic stud is of circular cross section and the notches are connected to form a threaded stud.

9. A construction as claimed in claim 1, wherein the unattached end of the stud extends into the cavity in the first anchor, after passage through an aperture in the anchor.

10. A construction as claimed in claim 9, wherein the cavity is filled with an insulating material.

11. A construction as claimed in claim 10, wherein the insulating material is insulating refractory fibers or refractory cements.

* * * * *